US010422539B2

(12) United States Patent
Son et al.

(10) Patent No.: US 10,422,539 B2
(45) Date of Patent: Sep. 24, 2019

(54) AIR CONDITIONER

(71) Applicant: LG ELECTRONICS INC., Seoul (KR)

(72) Inventors: Minsu Son, Seoul (KR); Kiwon Seo, Seoul (KR); Byungsoon Kim, Seoul (KR); Deok Huh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 237 days.

(21) Appl. No.: 14/924,807

(22) Filed: Oct. 28, 2015

(65) Prior Publication Data

US 2016/0123605 A1 May 5, 2016

(30) Foreign Application Priority Data

Oct. 31, 2014 (KR) ..... 10-2014-0150527

(51) Int. Cl.
*F24F 1/0014* (2019.01)
*F24F 1/0025* (2019.01)
(Continued)

(52) U.S. Cl.
CPC ..... *F24F 1/0014* (2013.01); *F24F 1/0011* (2013.01); *F24F 1/0025* (2013.01); *F24F 1/0033* (2013.01); *F24F 13/065* (2013.01)

(58) Field of Classification Search
CPC ..... F24F 1/0014; F24F 1/0011; F24F 1/0025; F24F 1/0033; F24F 13/065
See application file for complete search history.

(56) References Cited

U.S. PATENT DOCUMENTS 4,958,500 A 9/1990 Kuroda et al.
2010/0307019 A1* 12/2010 Park ..... A01K 13/001 34/90
(Continued)

FOREIGN PATENT DOCUMENTS

CN 102384533 3/2012
EP 1 772 678 4/2007
(Continued)

OTHER PUBLICATIONS

European Search Report dated Mar. 21, 2016.

*Primary Examiner* — Jon T. Schermerhorn, Jr.
(74) *Attorney, Agent, or Firm* — KED & Associates, LLP

(57) ABSTRACT

An air conditioner includes: a suction body having an air suction hole formed therein; a heat exchanger in which air sucked into the air suction hole is heat-exchanged; and a pair of blow discharge units through which the air heat-exchanged in the heat exchanger is passed and discharged. In the air conditioner, each of the pair of blow discharge units includes: a discharge body in which an air inflow hole and an air discharge hole are formed to be spaced apart from each other, and a discharge passage is formed between the air inflow hole and the air discharge hole; a rotation mechanism for rotating the discharge body about a vertical center axis; a cross flow fan rotatably positioned in the discharge passage, the cross flow fan being disposed vertically long in the discharge passage; and a fan motor having a vertical rotational shaft for rotating the cross flow fan. When the cross flow fan is mounted between the discharge body and the heat exchanger, the air conditioner can become more compact, and the utilization of space between the discharge body and the heat exchanger can be enhanced.

20 Claims, 10 Drawing Sheets

(51) Int. Cl.

| | |
|---|---|
| ***F24F 1/0011*** | (2019.01) |
| ***F24F 13/065*** | (2006.01) |
| ***F24F 1/0033*** | (2019.01) |

(56) References Cited

U.S. PATENT DOCUMENTS

| | | | | |
|---|---|---|---|---|
| 2013/0129515 | A1* | 5/2013 | Park | F01D 5/145 416/223 R |
| 2014/0308887 | A1 | 10/2014 | Yoon et al. | |

FOREIGN PATENT DOCUMENTS

| | | | |
|---|---|---|---|
| GB | 935934 | | 9/1963 |
| KR | 10-1346834 | B1 | 2/2009 |
| KR | 20120022248 | A * | 3/2012 |
| WO | WO 2007/136202 | | 11/2007 |

* cited by examiner

AIR CONDITIONER

BACKGROUND OF THE INVENTION

Field of the Invention

The present invention relates to an air conditioner and, more particularly, to an air conditioner in which a discharge body discharging air is rotatably disposed.

Related Art

In general, an air conditioner an air conditioner sucks air through an air suction hole to change temperature, humidity, cleanliness or the like, and then discharges the sucked air to the interior of a room through an air discharge hole to change the interior of room into a comfortable environment.

An air conditioner may have an air discharge hole formed to allow air to be discharged to the exterior. An air-conditioning unit such as a heat exchanger or a filter, which can change the temperature, humidity or cleanliness of air, may be installed inside the air conditioner. A blowing device for blowing air may be installed inside the air conditioner.

The air conditioner may include a discharge body having an air discharge hole formed therein. Vanes capable of determining the discharge direction of air may be rotatably disposed in the discharge body.

As an example, the discharge body may be disposed so that its position is fixed at an upper portion of the air conditioner. Therefore, the discharge body may discharge air-conditioned air into the interior of a room in the state in which its position is fixed.

As another example, the discharge body may be disposed to be ascendable/descendable at an upper portion of the air conditioner. Therefore, the discharge body may discharge air-conditioned air into the interior of a room at its ascended position and be then descended inside the air conditioner to be kept.

As still another example, the discharge body may be disposed to be laterally rotatable at an upper portion of the air conditioner. Therefore, the discharge body may laterally form a three-dimensional air current toward the periphery thereof while rotating at the upper portion of the air conditioner.

In KR 10-1346834 B1 (published on Jan. 2, 2014), there is disclosed an air conditioner in which a discharge grill is rotatably positioned at an upper portion of a main body, and a blower and a heat exchanger are disposed together inside the main body. However, the air conditioner has a problem in that the internal structure of the main body is complicated, and it is difficult to allow the main body to become compact.

SUMMARY OF THE INVENTION

The present invention provides an air conditioner which can become compact.

According to an aspect of the present invention, there is provided an air conditioner including: a suction body having an air suction hole formed therein; a heat exchanger in which air sucked into the air suction hole is heat-exchanged; and a pair of blow discharge units through which the air heat-exchanged in the heat exchanger is passed and discharged, wherein each of the pair of blow discharge units includes: a discharge body in which an air inflow hole and an air discharge hole are formed to be spaced apart from each other, and a discharge passage is formed between the air inflow hole and the air discharge hole; a rotation mechanism for rotating the discharge body about a vertical center axis; a cross flow fan rotatably positioned in the discharge passage, the cross flow fan being disposed vertically long in the discharge passage; and a fan motor having a vertical rotational shaft for rotating the cross flow fan.

The discharge body may include a hollow cylinder body formed vertically long, the hollow cylinder body in which an air inflow hole and an air discharge hole are formed vertically long; a upper plate covering the upper surface of the hollow cylinder body; and a lower plate covering the lower surface of the hollow cylinder body.

The fan motor may be mounted to one of the upper and lower plates.

The discharge body may further include: a stabilizer installed toward the cross flow fan in the hollow cylinder body; and an inner guide disposed long in the circumferential direction along the inner circumference of the hollow cylinder body, the inner guide 48 having a portion opposite to the stabilizer.

The fan motor may be mounted to the discharge body.

A fan motor accommodating portion having the fan motor accommodated therein may be formed in the discharge body.

The air conditioner may further include a discharge body supporter for rotatably supporting the discharge body. The fan motor may be mounted to discharge body supporter.

A rotational shaft through-hole having the vertical rotational shaft passed therethrough may be formed in the discharge body.

The air conditioner may include a control unit for controlling the rotation mechanism and the fan motor so that the rotational speed of the discharge body and the rotational speed of the cross flow fan are different from each other.

The control unit may control the rotation mechanism and the fan motor so that the rotational speed of the cross flow fan is faster than that of the discharge body.

The discharge body may be provided with a shaft support portion for rotatably supporting a support shaft formed in the cross flow fan.

The air conditioner may include: a lower supporter having the discharge body rotatably mounted thereto; and an upper supporter covering the upper surface of the discharge body.

The upper and lower supporters may be spaced apart from each other in the vertical direction.

The fan motor may be mounted to any one of the lower and upper supporters. The discharge body may be rotatably connected to the other of the lower and upper supporters.

The rear surface of the heat exchanger may be opposite to the suction body, and the front surface of the heat exchanger may be opposite to the pair of blow discharge units.

The air conditioner may further include a left plate forming the external appearance of the left surface of the air conditioner, and a right plate forming the external appearance of the right surface of the air conditioner. The left and right plates may cover between the heat exchanger and the pair of blow discharge units.

The pair of blow discharge units may include; a left blow discharge unit positioned at the left; and a right blow discharge unit positioned to be spaced apart from the left blow discharge unit at the right of the left blow discharge unit.

The air conditioner may include a control unit for controlling the rotation mechanism of the left blow discharge unit and the rotation mechanism of the right blow discharge unit so that the air discharge hole of the left blow discharge unit and the air discharge hole of the right blow discharge unit are directed in different directions.

The air conditioner may include a control unit for controlling the rotation mechanism of the left blow discharge unit and the rotation mechanism of the right blow discharge unit so that the discharge body of the left blow discharge unit and the discharge body of the right blow discharge unit are rotated at different rotational speed.

The air conditioner may include a control unit for controlling the fan motor of the left blow discharge unit and the fan motor of the right blow discharge unit in different blow modes so that the air volume of the cross flow fan of the left blow discharge unit and the air volume of the cross flow fan of the right blow discharge unit are different from each other.

According to the present invention, when the cross flow fan is mounted between the discharge body and the heat exchanger, the air conditioner can become more compact, and the utilization of space between the discharge body and the heat exchanger can be enhanced.

Also, when the discharge body is separated, the cross flow fan can be separated together with the discharge body, so that it is easy to obtain services of the cross flow fan and the fan motor.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE EMBODIMENTS

Embodiments of the present invention will be described in detail with reference to the accompanying drawings.

Figure 1:
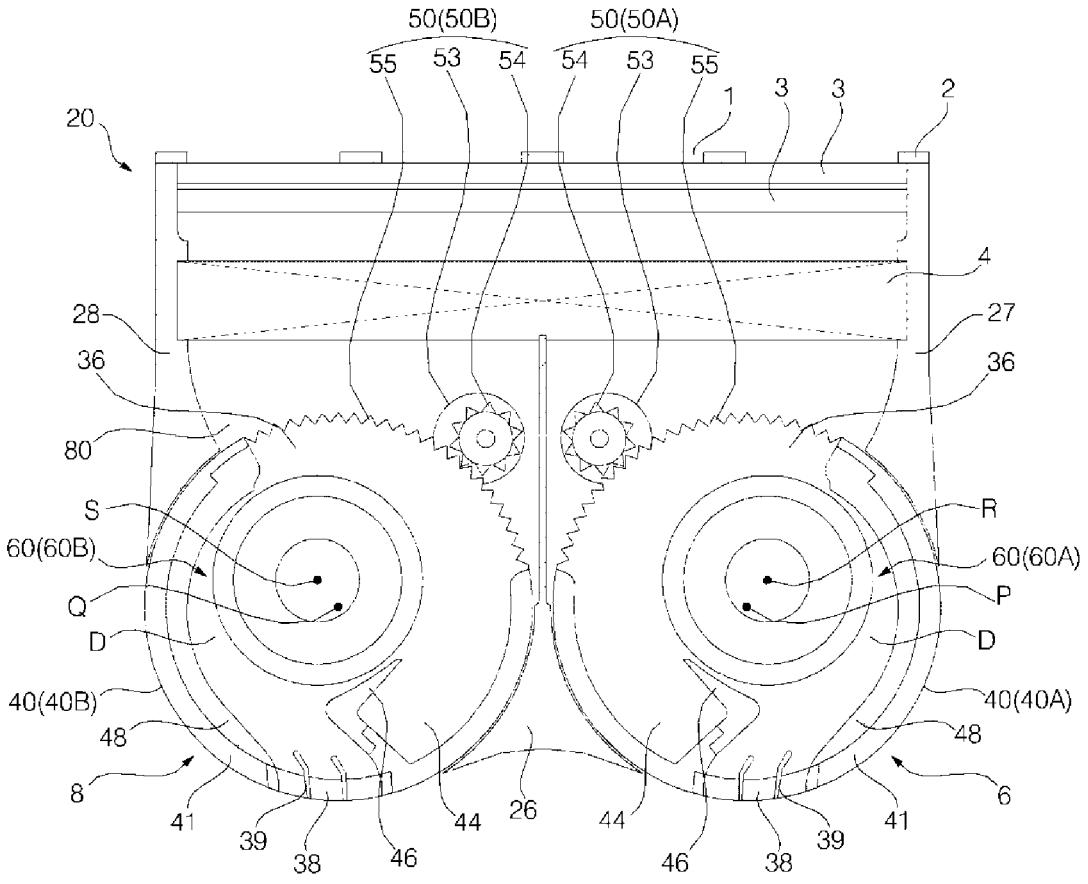
FIG. 1 is a cross-sectional view of an air conditioner according to an embodiment of the present invention.
Figure 2:
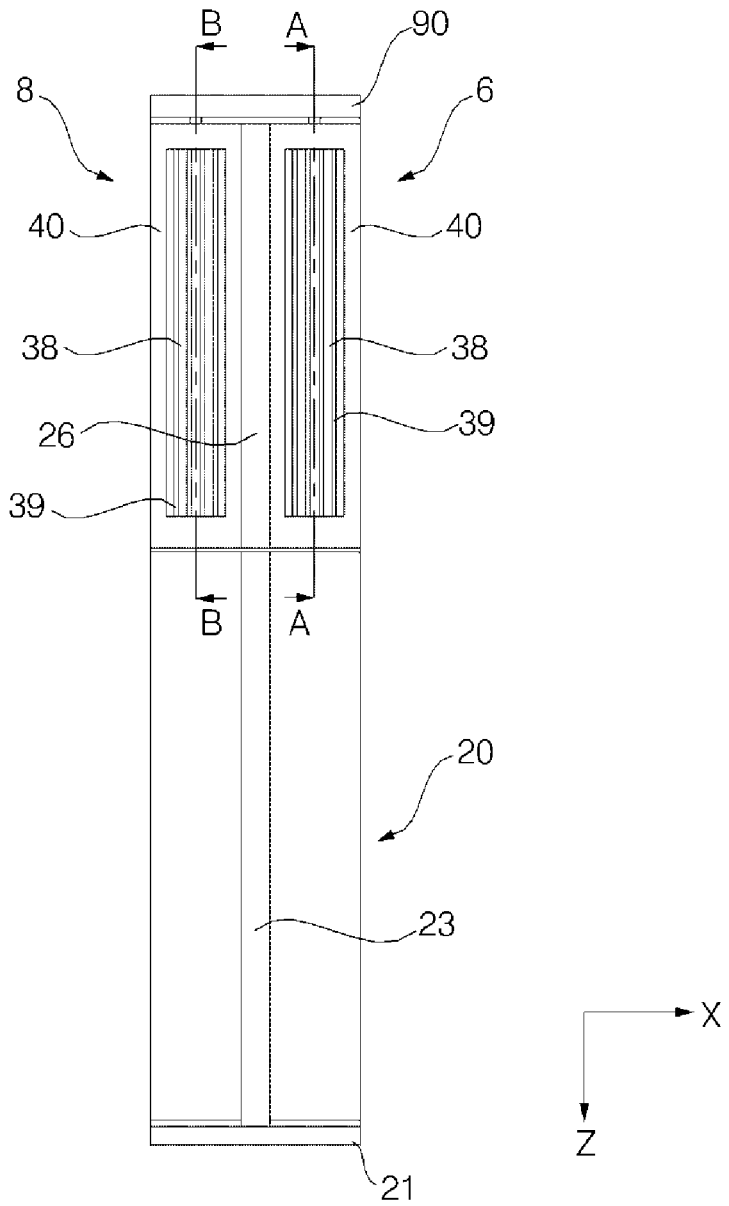
FIG. 2 is a front view of the air conditioner according to an embodiment of the present invention.
Figure 3:
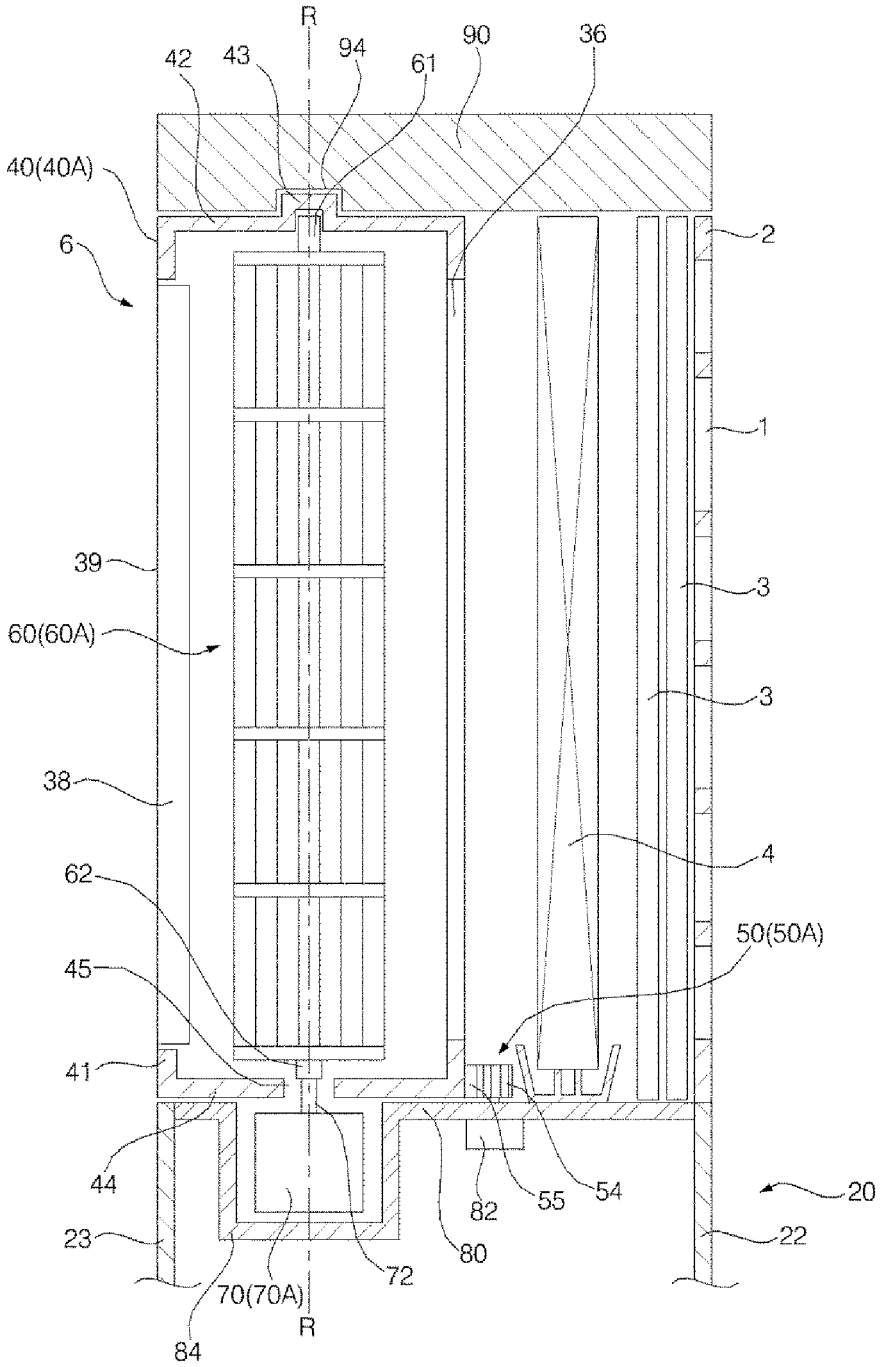
FIG. 3 is a sectional view taken along line A-A shown in FIG. 2.
Figure 4:
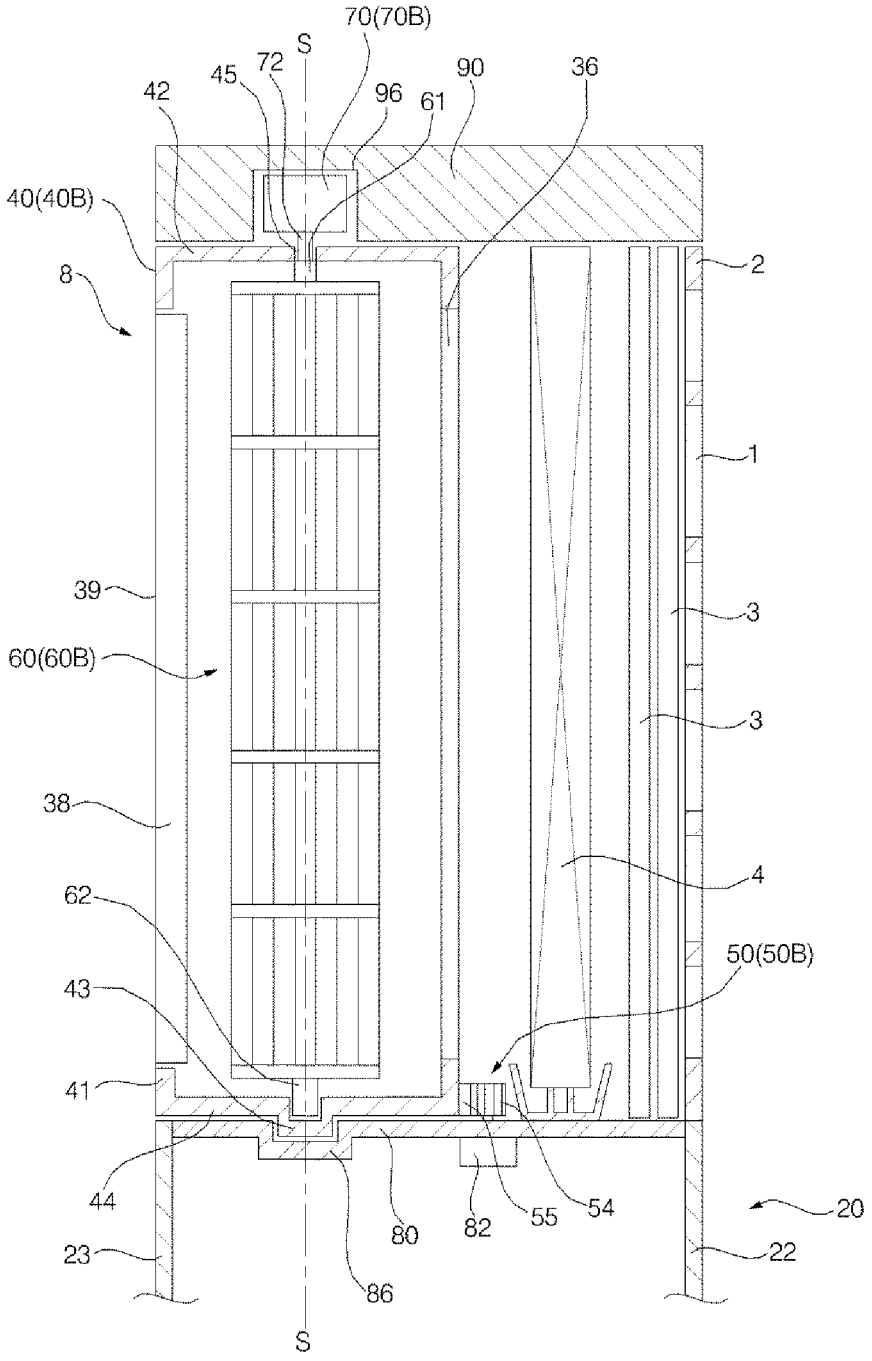
FIG. 4 is a sectional view taken along line B-B shown in FIG. 2.

FIG. 1 is a cross-sectional view of an air conditioner according to an embodiment of the present invention. FIG. 2 is a front view of the air conditioner according to an embodiment of the present invention. FIG. 3 is a sectional view taken along line A-A shown in FIG. 2. FIG. 4 is a sectional view taken along line B-B shown in FIG. 2.

The air conditioner may include a suction body 2 having an air suction hole 1 formed therein; a heat exchanger 4 with which air sucked into the air suction hole 1 is heat-exchanged; and a pair of blow discharge units 6 and 8 through which the air heat-exchanged in the heat exchanger 4 is passed and discharged.

The suction body 2 may be positioned at the opposite side of the pair of blow discharge units 6 and 8 to minimize that air discharged to the pair of blow discharge units 6 and 8 is not spread to the interior of a room but again sucked into the air suction hole 1. The suction body 2 may be positioned at a rear portion of the air conditioner, and the pair of blow discharge units 6 and 8 may suck air at the rear of the suction body 2 and allow the sucked air to pass through the heat exchanger 4.

An air cleaning unit 3 for cleaning air sucked into the air suction hole 1 may be installed in the suction body 2. The air cleaning unit 3 may include a filter through which foreign matters in the air are filtered. The air cleaning unit 3 may include an electric dust collector for discharging and collecting foreign matters in the air. The air cleaning unit 3 may include an ion generator for generating ions in the air.

The heat exchanger 4 may be positioned posterior to the air suction hole 1 in an air flow direction. The heat exchanger 4 may be positioned prior to the pair of blow discharge unit 6 and 8 in the air flow direction. The heat exchanger 4 may be positioned between the air suction hole 1 and the pair of blow discharge units 6 and 8 in the air flow direction.

The heat exchanger 4 may be provided to be positioned in front of the suction body 2, and the air passing through the suction body 2 in the interior of the room may be sucked into at least one of the pair of blow discharge unit 6 and 8 by passing through the heat exchanger 4. The heat exchanger 4 may be installed vertically inside the air conditioner. The rear surface of the heat exchanger 4 may be opposite to the suction body 2, and the front surface of the heat exchanger 4 may be opposite to the pair of blow discharge units 6 and 8.

The air conditioner may include a case 20 forming an external appearance thereof. The case 20 may include a base 21. The case 20 may include the suction body 2. The section body 2 may be disposed on the entire rear surface of the air conditioner. The case 20 may include a rear panel 22 on which the suction body 2 is mounted. The rear panel 22 may be disposed above the rear portion of the base 21 to form the external appearance of a lower portion of the rear surface of the air conditioner. The suction body 2 may be disposed above the rear panel 22 to form the external appearance of an upper portion of the rear surface of the air conditioner.

The case 20 may further include a front panel 23 forming the external appearance of a front lower portion of the air conditioner. The front panel 23 may be disposed above the front portion of the base 21. The case 20 may further include a partition wall 26 positioned between the pair of blow discharge units 6 and 8. The partition wall 26 may be disposed vertically long between the pair of blow discharge units 6 and 8. The left surface of the partition wall 26 may be opposite to a portion of any one of the pair of blow discharge units 6 and 8, and the right surface of the partition wall 26 may be opposite to a portion of the other of the pair of blow discharge units 6 and 8.

The case 20 may include a left plate 27 forming the external appearance of the left surface of the air conditioner, and a right plate 28 forming the external appearance of the right surface of the air conditioner. The left and right plates 27 and 28 may be spaced apart from each other in the lateral direction, and the heat exchanger 4 may be disposed between the left and right plates 27 and 28. The left and right plates 27 and 28 may cover between the heat exchanger 4 and the pair of blow discharge units 6 and 8.

In the air conditioner, air air-conditioned inside the air conditioner may be discharged to the exterior through at least one of the pair of blow discharge units 6 and 8.

The pair of blow discharge units 6 and 8 may allow external air to be sucked into the air suction hole 1 and pass through the heat exchanger 4. Then, the air may be sucked into the blow discharge units 6 and 8. The air sucked into the blow discharge units 6 and 8 may be discharged to the exterior.

The pair of the blow discharge units 6 and 8 may include a left blow charge unit 6 positioned at the left; and a right blow discharge unit 8 positioned at the right of the left blow discharge unit 6.

Each of the left and right blow discharge units 6 and 8 may be formed vertically long. Each of the left and right blow discharge units 6 and 8 may be rotatably disposed in the case 20. The left and right blow discharge units 6 and 8 may rotate independently to each other. The left and right blow discharge units 6 and 8 may discharge the air-conditioned air toward different regions in the interior of the room in which the air conditioner is installed. Each of the left and right blow discharge units 6 and 8 may rotate in the lateral direction about a vertical center axis.

When any one of the left and right blow discharge units 6 and 8 discharges the air-conditioned air to a left region in the interior of the room, the other of the left and right blow discharge units 6 and 8 may discharge the air-conditioned air to a right region in the interior of the room. Both the left and right blow discharge units 6 and 8 may discharge air to the front of the air conditioner.

The left and right blow discharge units 6 and 8 may be positioned at an upper portion of the air conditioner. The left and right blow discharge units 6 and 8 may be positioned to be spaced apart from each other in the lateral direction. The left and right blow discharge units 6 and 8 may have different positions and the same configuration. Hereinafter, common descriptions of the left and right blow discharge units 6 and 8 will be described as those of the blow discharge unit 6 or 8, and different descriptions of the left and right blow discharge units 6 and 8 will be described by being divided into descriptions of the first discharge unit 4 and descriptions of the second discharge unit 6.

Each of the pair of blow discharge units 6 and 8 may include a discharge body 40 in which an air inflow hole 36 and an air discharge hole 38 are formed to be spaced apart from each other, and a discharge passage D is formed between the air inflow hole 36 and the air discharge hole 38. The blow discharge unit 6 or 8 may include a rotation mechanism 50 for rotating the discharge body 40 about the vertical center axis. The blow discharge unit 6 or 8 may include a cross flow fan 60 rotatably positioned in a discharge passage D, the cross flow fan 60 being disposed vertically long in the discharge passage D. The blow discharge unit 6 or 8 may include a fan motor 70 having a vertical rotational shaft 72 for rotating the cross flow fan 60. Each of the pair of blow discharge units 6 and 8 may further include a discharge vane 39 for adjusting the air volume of air guided through the discharge body 40.

Hereinafter, common components of the discharge body 40 of the left blow discharge unit 6 and the discharge body of the right blow discharge unit 8 will be described as those of the discharge body 40. When different components of the discharge body 40 of the left blow discharge unit 6 and the discharge body of the right blow discharge unit 8 are described, the discharge body 40 of the left blow discharge unit 6 will be referred to as a first discharge body 40A, and the discharge body 40 of the right blow discharge unit 8 will be referred to as a second discharge body 40B.

The discharge body 40 may include a hollow cylinder body 41 formed vertically long, the hollow cylinder body 41 in which the air inflow hole 36 and the air discharge hole 38 are formed vertically long; an upper plate 42 covering the upper surface of the hollow cylinder body 41; and a lower plate 44 covering the lower surface of the hollow cylinder body 41.

The discharge body 40 may further include a stabilizer 46 installed toward the cross flow fan 60 in the hollow cylinder body 41. The discharge body 40 may further include an inner guide 48 disposed long in the circumferential direction along the inner circumference of the hollow cylinder body 41, the inner guide 48 having a portion opposite to the stabilizer 46.

A rotational shaft through-hole 45 having the vertical rotational shaft 72 passed therethrough may be formed in the discharge body 40. The rotational shaft through-hole 45 may be formed vertically hollow in any one of the upper and lower plates 42 and 44 of the discharge body 40.

The discharge body 40 is provided with a shaft support portion 43 for rotatably supporting a support shaft formed in the cross flow fan 60.

When the rotational shaft through-hole 45 is formed in the upper plate 42, the shaft support portion 43 may be formed at the lower plate 44. When the rotational shaft through-hole 45 is formed in the lower plate 44, the shaft support portion 43 may be formed at the upper plate 42.

The first discharge body 40A may be disposed vertically long at a left upper portion of the air conditioner, and a discharge passage D may be formed vertically long in the first discharge body 40A. The second discharge body 40B may be disposed vertically long at a right upper portion of the air conditioner, and a discharge passage D may be formed vertically long in the second discharge body 40B. The first discharge body 40A may discharge air toward the left direction of the first discharge body 40A, the front direction of the first discharge body 40A and the front left slant direction of the first discharge body 40A. The second discharge body 40B may discharge air toward the left direction of the second discharge body 40B, the front direction of the second discharge body 40B and the front right slant direction of the second discharge body 40B.

The rotation mechanism 50 of the left blow discharge unit 6 may rotate the left blow discharge unit 6 about a first vertical center axis P. The rotation mechanism 50 of the right blow discharge unit 8 may rotate the right blow discharge unit 8 about a second vertical center axis Q. The first and second vertical center axes P and Q may be directed in upper and lower directions, respectively, and may be parallel with each other.

Hereinafter, common components of the rotation mechanism 50 of the left blow discharge unit 6 and the rotation mechanism 50 of the right blow discharge unit 8 will be described as those of the rotation mechanism 50. When different components of the rotation mechanism 50 of the left blow discharge unit 6 and the rotation mechanism 50 of the right blow discharge unit 8 are described, the rotation mechanism 50 of the left blow discharge unit 6 will be referred to as a first rotation mechanism 50A, and the rotation mechanism 50 of the right blow discharge unit 8 will be referred to as a second rotation mechanism 50B.

The rotation mechanism 50 may include a motor 53, a driving gear 54 connected to a rotational shaft of the motor 53, and a driven gear 55 formed in the blow discharge unit 6 or 8, the driven gear 55 being engaged with the driving gear 54.

The motor 53 may be provided in the air conditioner. The motor 53 may be a driving source which rotates the blow discharge unit 6 or 8. The motor 53 may be provided so that its rotational shaft protrudes upward. The motor 53 may be installed in the case 20. The motor 53 may be provided at one of discharge body supporters 80 and 90. The motor 53 of the first rotation mechanism 50A and the motor 53 of the second rotation mechanism 50B may be driven at the same angle or speed. It will be apparent that the motor 53 of the first rotation mechanism 50A and the motor 53 of the second rotation mechanism 50B may be controlled at different angles or speeds.

The driving gear 54 may receive driving power of the motor 53 to transmit the received driving power to the driven gear 55. The driving gear 54 may be positioned between the motor 53 and the driven gear 55. The driving gear 54 may rotate the driven gear 55 when the motor 53 is driven.

The driven gear 55 may be formed in each of the left and right blow discharge units 6 and 8. When the motor 53 is driven, the driven gear 55 may be rotated by the driving gear 54 to rotate the blow discharge unit 6 or 8. The driven gear 55 of the first rotation mechanism 50A may be formed in the discharge body 40 of the left blow discharge unit 6, and the driven gear 55 of the second rotation mechanism 50B may be formed in the discharge body 40 of the right blow discharge unit 8.

Hereinafter, common components of the cross flow fan 60 of the left blow discharge unit 6 and the cross flow fan 60 of the right blow discharge unit 8 will be described as those of the cross flow fan 60. When different components of the cross flow fan 60 of the left blow discharge unit 6 and the cross flow fan 60 of the right blow discharge unit 8 are described, the cross flow fan 60 of the left blow discharge unit 6 will be referred to as a first cross flow fan 60A, and the cross flow fan 60 of the right blow discharge unit 8 will be referred to as a second cross flow fan 60B.

The cross flow fan 60 has an upper shaft 61 formed at an upper portion thereof, and a lower shaft 62 formed at a lower portion thereof. The cross flow fan 60 may allow air to flow while rotating about a vertical center axis. In the cross flow fan 60, any one of the upper and lower shafts 61 and 62 may be a driving shaft connected to the rotational shaft 72 of the fan motor 70, and the other of the upper and lower shafts 61 and 62 may be a support shaft rotatably supported to the shaft support portion 43 formed at the discharge body 40.

The first and second cross flow fans 60A and 60B may be positioned in parallel to each other. The first cross flow fan 60A may rotate about a first cross flow fan center axis R connecting the upper and lower shafts 61 and 62 of the first cross flow fan 60A. The first cross flow fan center axis R may disagree with the first vertical center axis P. The second cross flow fan 60B may rotate about a second cross flow fan center axis S connecting the upper and lower shafts 61 and 62 of the second cross flow fan 60B. The second cross flow fan center axis S may disagree with the second vertical center axis Q.

Hereinafter, common components of the fan motor 70 of the left blow discharge unit 6 and the fan motor 70 of the right blow discharge unit 8 will be described as those of the fan motor 70. When different components of the fan motor 70 of the left blow discharge unit 6 and the fan motor 70 of the right blow discharge unit 8 are described, the fan motor 70 of the left blow discharge unit 6 will be referred to as a first fan motor 70A, and the fan motor 70 of the right blow discharge unit 8 will be referred to as a second fan motor 70B.

The fan motor 70 may be provided so that the vertical rotational shaft 72 is disposed in the vertical direction. The fan motor 70 may be provided to be positioned above the discharge body 40 to rotate the discharge body 40 above the discharge body 40. The fan motor 70 may be provided to be positioned below of the discharge body 40 to rotate the discharge body 40 below the discharge body 40.

When any one of the first and second fan motors 70A and 70B is positioned above any one of the first and second discharge bodies 40A and 40B, the other of the first and second fan motors 70A and 70B may be positioned below the other of the first and second discharge bodies 40A and 40B. For example, in a case where the first fan motor 70A is positioned above the first discharge body 40A, the second fan motor 70B may be provided to be positioned below the second discharge body 40B, and it will be apparent that the opposite case is possible.

The air conditioner may further include discharge body supporters 80 and 90 for rotatably supporting the discharge body 40. The fan motor 70 may be mounted to the discharge body supporters 80 and 90.

The discharge body supporters 80 and 90 may include a lower supporter 80 to which the discharge body 40 is rotatably mounted. The lower supporter 80 may simultaneously support the first and second discharge bodies 40A and 40B. The lower supporter 80 may be disposed in parallel to the case 20. The lower supporter 80 may receive loads of the first and second discharge bodies 40A and 40B. The lower supporter 80 may constitute a portion of the case 20. The lower supporter 80 may be disposed between the rear and front panels 22 and 23. The motor 53 of the rotation mechanism 50 may be mounted to the lower supporter 80, and a motor mounting portion 82 where the motor 53 of the rotation mechanism 50 is mounted may be formed at the lower supporter 80.

The discharge body supporters 80 and 90 may include an upper supporter 90 covering the upper surface of the discharge body 40. The upper supporter 90 may be a top cover which protects the upper surface of the discharge body 40 and forms the external appearance of a portion of the upper surface of the air conditioner. The upper supporter 90 may be disposed in parallel to the case 20. The upper supporter 90 may rotatably support the first and second discharge bodies 40A and 40B. The upper supporter 90 may be spaced apart from each other in the vertical direction. The upper supporter 90 may be spaced apart from the discharge body 40 at a distance equal to or slightly greater than the height of the discharge body 40.

The fan motor 70 may be mounted to any one of the lower and upper supporters 80 and 90, and the discharge body 40 may be rotatably connected to the other of the lower and upper supporters 80 and 90.

When any one of the first and second fan motors 70A and 70B is mounted to the lower supporter 80, the other of the first and second fan motors 70A and 70B may be mounted to the upper supporter 90.

In a case where the first fan motor 70A is mounted to the lower supporter 80, an upper portion of the first discharge body 40A may be rotatably connected to the upper supporter 90. In this case, the second fan motor 70B may be mounted to the upper supporter 90, and a lower portion of the second discharge body 40B may be rotatably connected to the lower supporter 80.

On the contrary, in a case where the second fan motor 70B is mounted to the lower supporter 80, an upper portion of the second discharge body 40B may be rotatably connected to the upper supporter 90. In this case, the first fan motor 70A may be mounted to the upper supporter 90, and a lower portion of the first discharge body 40A may be rotatably connected to the lower supporter 80.

Referring to FIG. 3, in a case where the first fan motor 70A is mounted to the lower supporter 80, the upper portion of the first discharge body 40A may be rotatably connected to the upper supporter 90. A motor mounting portion 84 in which the first fan motor 70A is mounted may be formed at the lower supporter 80, and the first fan motor 70A may be mounted by being inserted into the motor mounting portion 84. The first fan motor 70A may be protected by the motor mounting portion 84. In this case, the load of the first fan motor 70A may act on the lower supporter 80. The upper supporter 90 may be rotatably connected to the first discharge body 40A. A support groove 94 for rotatably supporting the shaft support portion 43 formed at the upper portion of the first discharge body 40A may be formed in the upper supporter 90.

Referring to FIG. 4, in a case where the second fan motor 70B is mounted to the upper supporter 90, the lower portion of the second discharge body 40B may be rotatably connected to the lower supporter 80. A motor mounting portion 96 in which the second fan motor 70B is mounted may be formed at the upper supporter 90, and the second fan motor 70B may be mounted by being inserted into the motor mounting portion 96. The second fan motor 70B may be protected by the motor mounting portion 96. The lower supporter 80 may be rotatably connected to the second discharge body 40B. A support groove 86 for rotatably supporting the shaft support portion 43 formed at the lower portion of the second discharge body 40B may be formed in the lower supporter 90.

Figure 5:
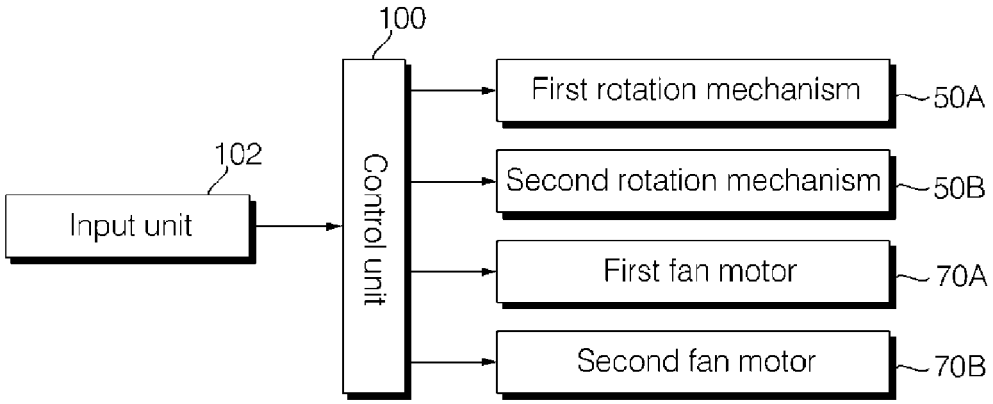
FIG. 5 is a block diagram of the air conditioner according to an embodiment of the present invention.
Figure 6:
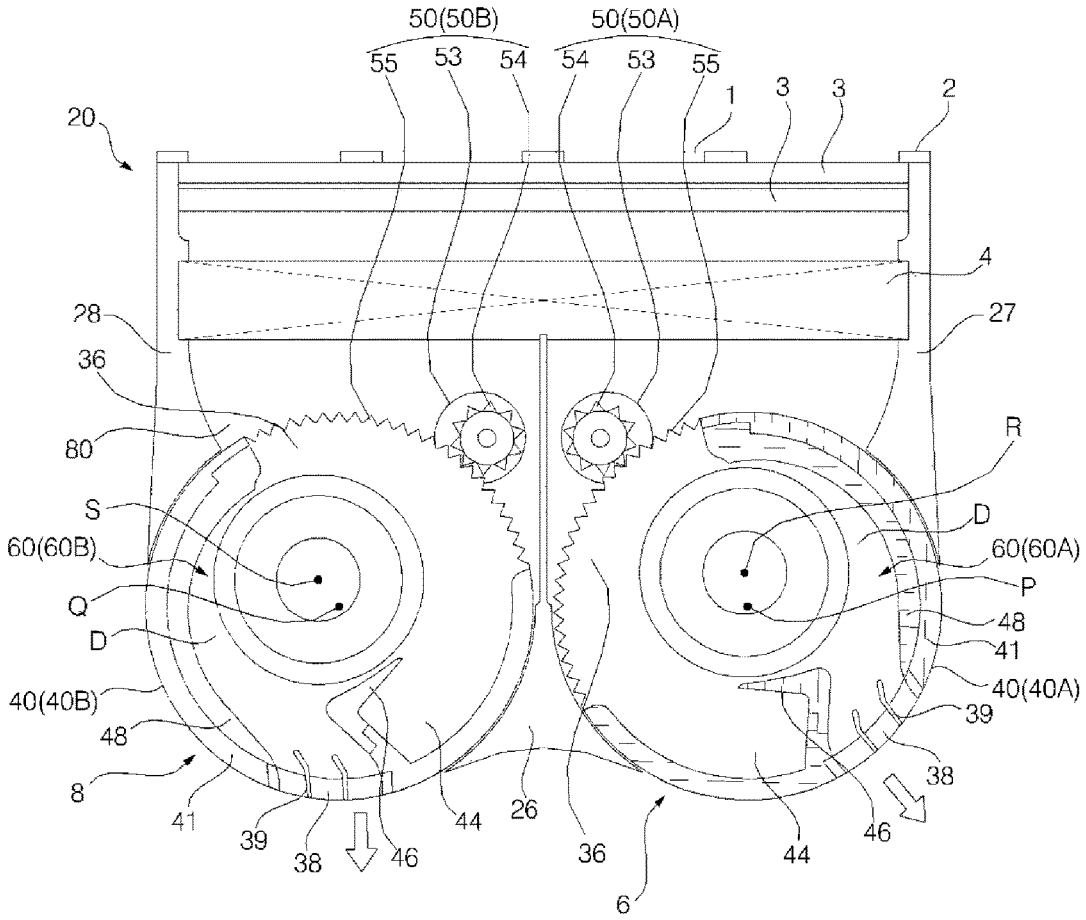
FIG. 6 is a cross-sectional view when the discharge directions of left and right blow discharge units shown in FIG. 1 are different from each other.
Figure 7:
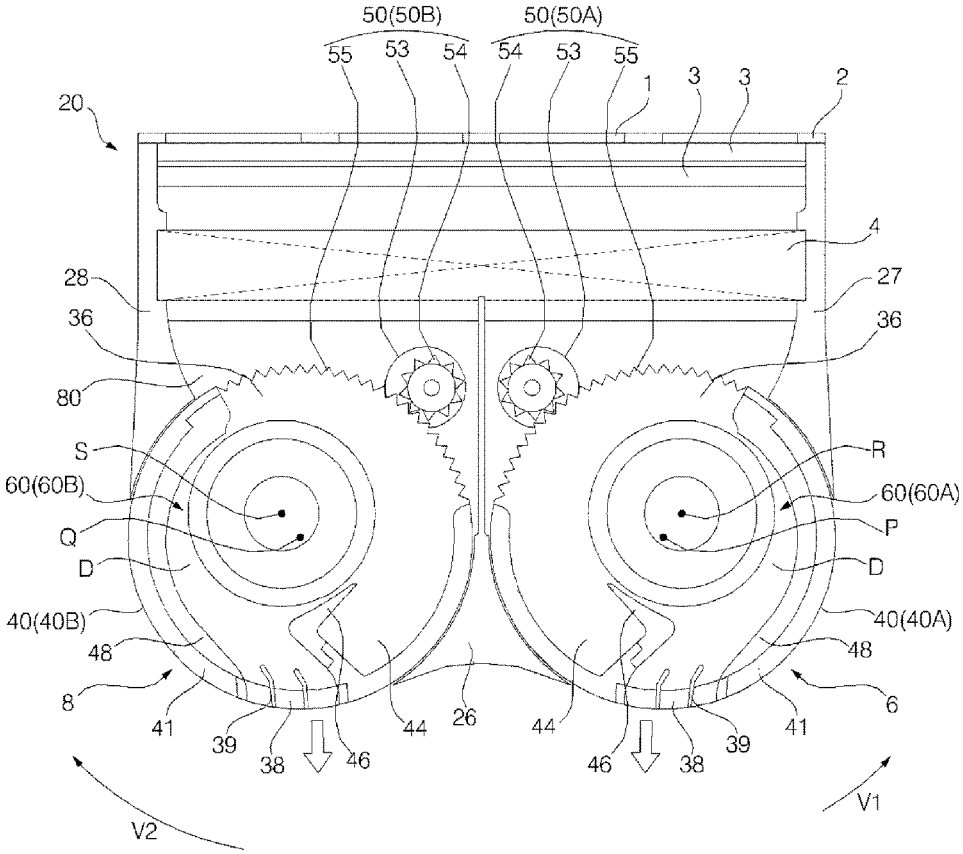
FIG. 7 is a cross-sectional view when the rotational speeds of the left and right blow discharge units shown in FIG. 1 are different from each other.
Figure 8:
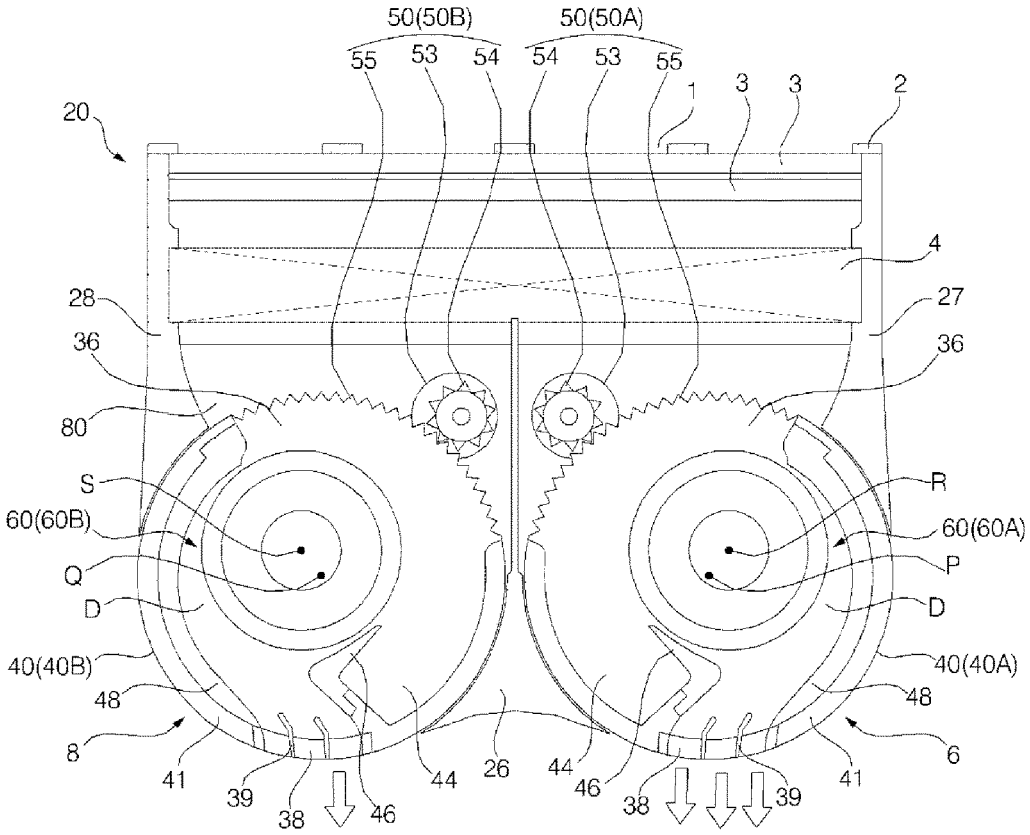
FIG. 8 is a cross-sectional view when the air volumes of the left and right blow discharge units shown in FIG. 1 are different from each other.

FIG. 5 is a block diagram of the air conditioner according to an embodiment of the present invention. FIG. 6 is a cross-sectional view when the discharge directions of the left and right blow discharge units shown in FIG. 1 are different from each other. FIG. 7 is a cross-sectional view when the rotational speeds of the left and right blow discharge units shown in FIG. 1 are different from each other. FIG. 8 is a cross-sectional view when the air volumes of the left and right blow discharge units shown in FIG. 1 are different from each other.

The air conditioner may further include a control unit 100 for controlling the rotation mechanism 50 and the fan motor 70. The control unit 100 may control the motor 53 of the first rotation mechanism 50A and the motor 53 of the second rotation mechanism 50B with different control patterns. The control unit 100 may control the first and second fan motors 70A and 70B in different blow modes. The air conditioner may further include an input unit 102 for allowing a command to be input from the exterior. The control unit 100 may control the rotation mechanism 50 and the fan motor 70 according to an input of the input unit 102. The input unit 102 may include a discharge mode input unit for allowing discharge modes of the pair of blow discharge units 6 and 8 to be input therethrough. The discharge mode input unit may be configured so that the discharge modes of the pair of blow discharge units 6 and 8 can be individually input. The input unit 102 may include a blow mode input unit for allowing blow modes of the pair of blow discharge units 6 and 8 to be input therethrough. The blow mode input unit may be configured so that the blow modes of the pair of blow discharge units 6 and 8 can be individually input.

The control unit 100 may control the rotation mechanism 50 and the fan motor 70 so that the rotational speed of the discharge body 40 and the rotational speed of the cross flow fan 60 are different from each other. The control unit 100 may control the rotation mechanism 50 and the fan motor 70 so that the rotational speed of the cross flow fan 60 is faster than that of the discharge body 40. The control unit 100 may control the motor 53 of the first rotation mechanism 50 and the first fan motor 70A at different speeds. The control unit 100 may control the first fan motor 70A at a speed faster than that of the motor 53 of the first rotation mechanism 50.

The control unit 100, as shown in FIG. 6, may control the rotation mechanism 50 of the left blow discharge unit 6 and the rotation mechanism 50 of the right blow discharge unit 8 so that the air discharge hole 38 of the left blow discharge unit 6 and the air discharge hole 38 of the right blow discharge unit 8 are directed in different directions. For example, the control unit 100 may control the first rotation mechanism 50A so that the air discharge hole 38 of the left blow discharge unit 6 discharges air in the slant direction of the front left of the left blow discharge unit 6. In this state, the control unit 100 may control the second rotation mechanism 60B so that the air discharge hole 38 of the right blow discharge unit 8 discharges air in the front direction of the right blow discharge unit 8.

The control unit 100 may control the rotation mechanism 50 so that, when the air discharge hole 38 of the left blow discharge unit 6 discharges air in the left direction, the air discharge hole 38 of the right blow discharge unit 8 discharges air in any one of the right direction, front right direction and the front direction. The control unit 100 may control the rotation mechanism 50 so that, when the air discharge hole 38 of the left blow discharge unit 6 discharges air in the front left direction, the air discharge hole 38 of the right blow discharge unit 8 discharges air in any one of the right direction, the front right direction and the front direction. The control unit 100 may control the rotation mechanism so that, when the air discharge hole 38 of the left blow discharge unit 6 discharges air in the front direction, the air discharge hole 38 of the right blow discharge unit 8 discharges air in any direction of the right direction, the front right direction and the front direction.

The control unit 100 may control the rotation mechanism 50 so that the right blow discharge unit 8 is laterally rotated in a state in which the left blow discharge unit 6 is not laterally rotated, and its discharge direction is fixed. On the contrary, the control unit 100 may control the rotation mechanism 50 so that the left blow discharge unit 6 is laterally rotated in a state in which the discharge direction of the right blow discharge unit 8 is fixed.

The control unit 100, as shown in FIG. 7, may control the rotation mechanism 50 or the left blow discharge unit 6 and the rotation mechanism 50 of the right blow discharge unit 8 so that the discharge body 40 of the left blow discharge unit 6 and the discharge body 40 of the right blow discharge unit 8 are rotated at different rotational speeds. The control unit 100 may control both the left and right blow discharge units 6 and 8 to be laterally rotated. In this state, the control unit 100 may control any one of the left and right blow discharge units 6 and 8 to be rotated at a rotational speed faster than that of the other of the left and right blow discharge units 6 and 8. For example, when the left blow discharge unit 6 is rotated at a first rotational speed V1, the control unit 100 may control the right blow discharge unit 8 to be rotated at a second rotational speed V2 faster than the first rotational speed V1.

The control unit 100, as shown in FIG. 8, may control the fan motor 70 of the left blow discharge unit 6 and the fan motor 70 of the right blow discharge unit 8 in different blow modes so that the cross flow fan 60 of the left blow discharge unit 6 and the cross flow fan 60 of the right blow discharge unit 8 have different air volumes. For example, when the control unit 100 controls the fan motor 70 of the left blow discharge unit 6 in a strong air mode, the control mode 100 may control the fan motor 70 of the right blow discharge unit 8 in a weak air mode. In this case, the air conditioner may discharge a larger amount of cool air to the left region of the left and right regions in the interior of a room, and the left and right regions in the interior of the room may be controlled at different temperatures.

Figure 9:
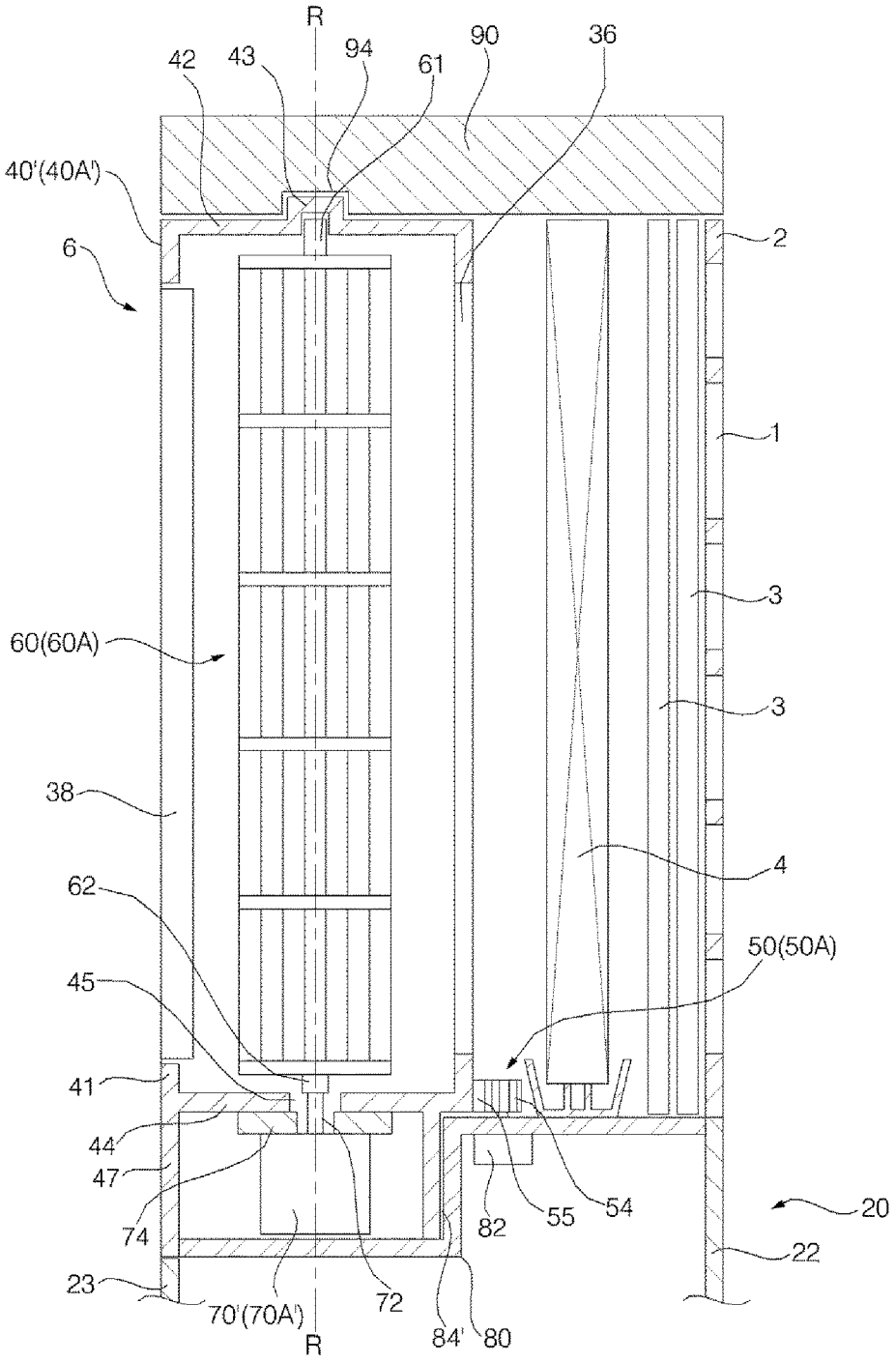
FIG. 9 is a longitudinal sectional view showing a left blow discharge unit of the air conditioner according to another embodiment of the present invention.
Figure 10:
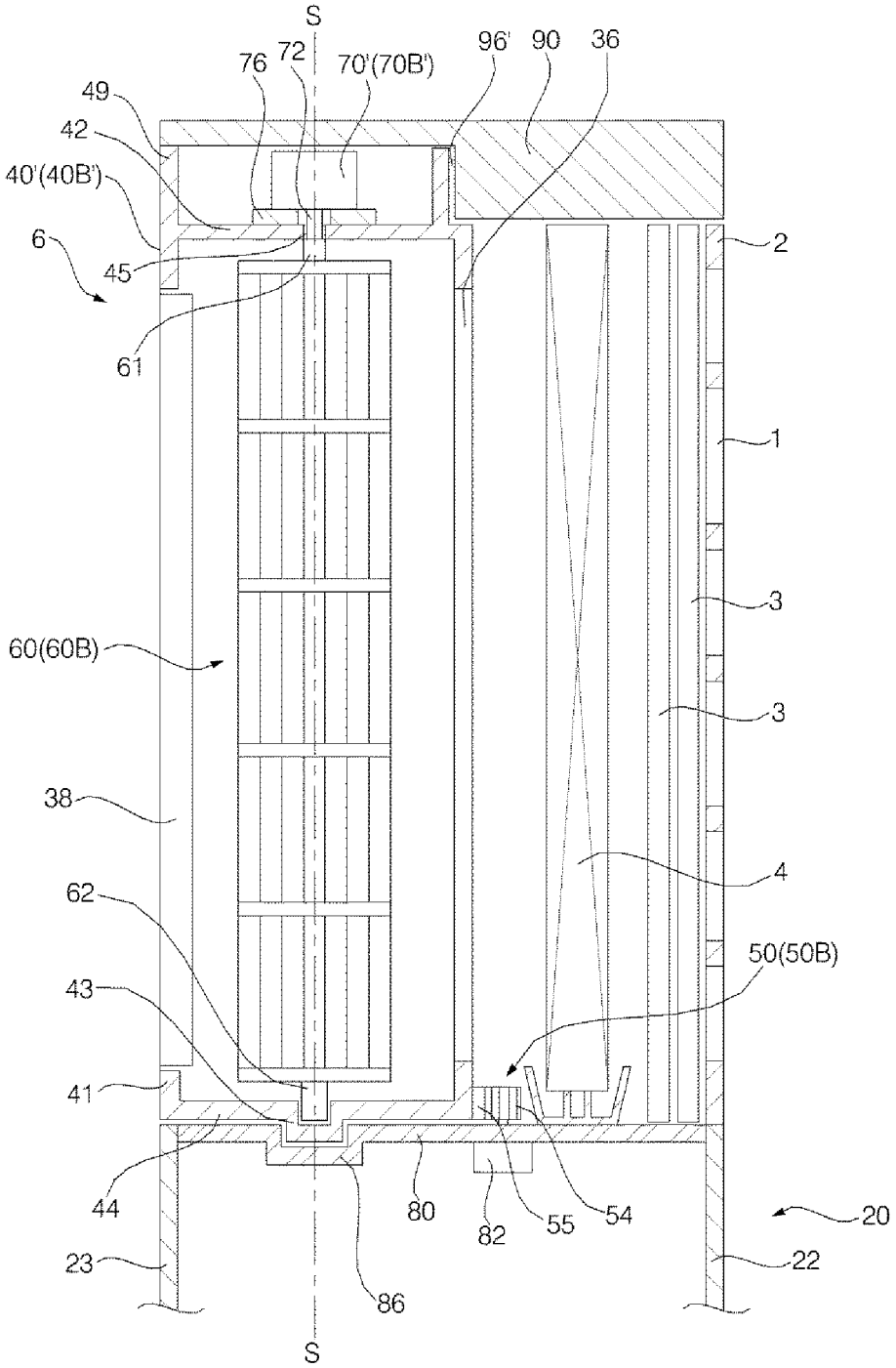
FIG. 10 is a longitudinal sectional view showing a right blow discharge unit of the air conditioner according to another embodiment of the present invention.

FIG. 9 is a longitudinal sectional view showing a left blow discharge unit of the air conditioner according to another embodiment of the present invention. FIG. 10 is a longitudinal sectional view showing a right blow discharge unit of the air conditioner according to another embodiment of the present invention.

In this embodiment, a fan motor 70' may be mounted to a discharge body 40'. The fan motor 70' may be mounted to one of the upper and lower plates 42 and 44 of the discharge body 40'. The other components and operations, except that the fan motor 70' is mounted to the discharge body 40', are identical or similar to those of the embodiment described above. Therefore, the identical or similar components are designated by like reference numerals, and their detailed descriptions will be omitted.

A fan motor accommodating portion having the fan motor 70' accommodated therein may be formed in the discharge body 40'. The fan motor accommodating portion may be formed to surround the circumferential surface of the fan motor 70'.

Referring to FIG. 9, a first fan motor 70A' that is the fan motor 70' of the left blow discharge unit 6 may be mounted to a first discharge body 40A' to be rotated together with the first discharge body 40A' when the first discharge body 40A' is rotated. The load of the first fan motor 70A' may act on the first discharge body 40A'.

A first fan motor accommodating portion 47 having the first fan motor 70A' accommodated therein may be formed in the first discharge body 40A', and the first fan motor 70A' may be positioned inside the first fan motor accommodating portion 47. The first fan motor accommodating portion 47 may be formed at the lower plate 44 of the first discharge body 40A'. The first fan motor accommodating portion 47 may be formed in the shape of a hollow cylinder body at the lower plate 44 of the first discharge body 40A', and the lower surface of the first fan motor accommodating portion 47 may be open.

The first fan motor 70A' may be mounted to be positioned below the lower plate 44 of the first discharge body 40A'. The first fan motor 70A' may be mounted to the first discharge body 40A' by a motor mounter 74. The motor mounter 74 may be mounted to the lower plate 44 of the first discharge body 40A' or the first fan motor accommodating portion 47.

The lower supporter 80 may be provided with a first fan motor accommodating portion support portion 84' for rotatably accommodating the first fan motor accommodating portion 47.

Referring to FIG. 10, a second fan motor 70B' that is the fan motor 70' of the right blow discharge unit 8 may be mounted to a second discharge body 40B' to be rotated together with the second discharge body 40B' when the second discharge body 40B' is rotated. The load of the second fan motor 70B' may act on the second discharge body 40B'.

A second fan motor accommodating portion 49 having the second fan motor 70B' accommodated therein may be formed in the second discharge body 40B', and the second fan motor 70B' may be positioned inside the second fan motor accommodating portion 49. The second fan motor accommodating portion 49 may be formed at the upper plate 42 of the second discharge body 40B'. The second fan motor accommodating portion 49 may be formed in the shape of a hollow cylinder body at the upper plate 42 of the second discharge body 40B', and the upper surface of the second fan motor accommodating portion 49 may be open.

The second fan motor 70B' may be mounted to be positioned above the upper plate 42 of the second discharge body 40B'. The second fan motor 70B' may be mounted to the second discharge body 40B' by a motor mounter 76. The motor mounter 76 may be mounted to the upper plate 42 of the second discharge body 40B' or the second fan motor accommodating portion 49.

The upper supporter 90 may be provided with a second fan motor accommodating portion support portion 96' for rotatably accommodating the second fan motor accommodating portion 49.

While the present invention has been shown and described in connection with the embodiments, it will be apparent to those skilled in the art that modifications and variations can be made without departing from the spirit and scope of the invention as defined by the appended claims.

What is claimed is:

1. An air conditioner comprising:

a suction body having an air suction hole formed therein;

a heat exchanger in which air sucked into the air suction hole is heat-exchanged;

a pair of blow discharge units through which the air heat-exchanged in the heat exchanger is passed and discharged, wherein the pair of blow discharge units includes a pair of discharge bodies, and wherein each of the pair of blow discharge units includes:

a respective discharge body of the pair of discharge bodies in which an air inflow hole and an air discharge hole are formed to be spaced apart from each other, and a discharge passage is formed between the air inflow hole and the air discharge hole, wherein the respective discharge body includes a hollow cylinder body having a vertical axis, the hollow cylinder body including the air inflow hole and the air discharge hole that extend vertically along the hollow cylinder body, wherein the air inflow hole is located in front of the heat exchanger such that the air having been heat-exchanged in the heat exchanger is sucked into the hollow cylinder body through the air inflow hole;

a rotation mechanism including a motor that rotates the discharge body about a respective vertical center axis;

a cross flow fan rotatably positioned in the discharge passage, the cross flow fan being disposed vertically long in the discharge passage; and a fan motor having a vertical rotational shaft to rotate the cross flow fan, wherein the pair of discharge bodies is formed vertically parallel to each other, and is rotated about each respective vertical axis independently from each other by each respective rotation mechanism; and a controller adapted to control the motor which rotates a first discharge body of the pair of discharge bodies and the motor which rotates a second discharge body of the pair of discharge bodies such that the first discharge body and the second discharge body are rotated about each respective vertical center axis to discharge the heat exchanged air toward different regions through each respective discharge hole.

2. The air conditioner of claim 1, wherein each respective discharge body includes:

a upper plate covering the upper surface of the hollow cylinder body; and a lower plate covering the lower surface of the hollow cylinder body.

3. The air conditioner of claim 2, wherein each fan motor is mounted to one of the upper and lower plates.

4. The air conditioner of claim 2, wherein each respective discharge body further includes:

a stabilizer installed toward the cross flow fan in the hollow cylinder body; and an inner guide disposed long in a circumferential direction along an inner circumference of the hollow cylinder body, the inner guide having a portion opposite to the stabilizer.

5. The air conditioner of claim 1, wherein each fan motor is mounted to the respective discharge body.

6. The air conditioner of claim 5, wherein a fan motor accommodating portion having the fan motor accommodated therein is formed in each respective discharge body.

7. The air conditioner of claim 1, further comprising a discharge body supporter to rotatably support each discharge body, wherein each fan motor is mounted to the respective discharge body supporter.

8. The air conditioner of claim 7, wherein a rotational shaft through-hole having the vertical rotational shaft passed therethrough is formed in each respective discharge body.

9. The air conditioner of claim 1, wherein the controller controls each rotation mechanism and each fan motor so that a rotational speed of each respective discharge body and a rotational speed of each cross flow fan are different from each other.

10. The air conditioner of claim 9, wherein the controller controls each rotation mechanism and each fan motor so that the rotational speed of each cross flow fan is faster than the rotational speed of each respective discharge body.

11. The air conditioner of claim 1, wherein each respective discharge body is provided with a shaft support portion to rotatably support a support shaft formed in the respective cross flow fan.

12. The air conditioner of claim 1, further comprising:

a lower supporter having each respective discharge body rotatably mounted thereto; and an upper supporter covering the upper surface of each respective discharge body.

13. The air conditioner of claim 12, wherein the upper and lower supporters are spaced apart from each other in the vertical direction.

14. The air conditioner of claim 13, wherein each fan motor is mounted to any one of the lower and upper supporters, and wherein each respective discharge body is rotatably connected to the other of the lower and upper supporters.

15. The air conditioner of claim 1, wherein a rear surface of the heat exchanger is opposite to the suction body, and a front surface of the heat exchanger is opposite to the pair of blow discharge units.

16. The air conditioner of claim 1, further comprising a first plate forming an external appearance of a first surface of the air conditioner, and a second plate forming an external appearance of a second surface of the air conditioner, wherein the first and second plates cover a space between the heat exchanger and the pair of blow discharge units.

17. The air conditioner of claim 1, wherein the pair of blow discharge units includes:

a first blow discharge unit positioned at the left; and a second blow discharge unit positioned to be spaced apart from the first blow discharge unit at a lateral side of the first blow discharge unit.

18. The air conditioner of claim 17, wherein the controller controls the rotation mechanism of the first blow discharge unit and the rotation mechanism of the second blow discharge unit so that the air discharge hole of the first blow discharge unit and the air discharge hole of the second blow discharge unit are directed in different directions.

19. The air conditioner of claim 17, wherein the controller controls the rotation mechanism of the first blow discharge unit and the rotation mechanism of the second blow discharge unit so that the discharge body of the first blow discharge unit and the discharge body of the second blow discharge unit are rotated at different rotational speed.

20. The air conditioner of claim 17, wherein the controller controls the fan motor of the first blow discharge unit and the fan motor of the second blow discharge unit in different blow modes so that an air volume of the cross flow fan of the first blow discharge unit and an air volume of the cross flow fan of the second blow discharge unit are different from each other.

* * * * *